US005138860A

United States Patent [19]

Del Fabro et al.

[11] Patent Number: 5,138,860

[45] Date of Patent: Aug. 18, 1992

[54] COMBINED ASSEMBLY TO STRAIGHTEN AND LINEARIZE BARS OR RODS

[75] Inventors: Giorgio Del Fabro, Cassacco-Fraz.Montegnacco; Marcello Del Fabro, Via Chisimaio 43/7, 33100 Udine, both of Italy

[73] Assignees: Marcello Del Fabro; M.E.P. Macchine Elettroniche Piegatrici SpA

[21] Appl. No.: 667,627

[22] Filed: Mar. 11, 1991

[30] Foreign Application Priority Data

Mar. 15, 1990 [IT] Italy ..... 83348 A/90

[51] Int. Cl.[5] ..... B21D 3/05; B21F 1/02

[52] U.S. Cl. ..... 72/164; 672/162

[58] Field of Search ..... 72/162, 164, 165, 160, 72/34

[56] References Cited

U.S. PATENT DOCUMENTS

| | | | |
|---|---|---|---|
| 2,391,499 | 12/1945 | Yoder | 72/164 |
| 2,639,758 | 5/1953 | Heller | 72/162 |
| 2,693,219 | 11/1954 | Heller | 72/162 |
| 3,893,316 | 7/1975 | Simich | 72/162 |
| 4,876,873 | 10/1989 | Del Fabro | 72/162 |

FOREIGN PATENT DOCUMENTS

| | | | |
|---|---|---|---|
| 1041849 | 9/1966 | United Kingdom | 72/164 |
| 1132609 | 11/1968 | United Kingdom . | |

*Primary Examiner*—Daniel C. Crane

*Attorney, Agent, or Firm*—Antonelli, Terry Stout & Kraus

[57] ABSTRACT

Combined assembly to straighten and linearize bars or rods (11), the bars or rods (11) having a substantially round or specially shaped but round-like section, a ribbed section or section with protrusions or with TOR-type helicoidal ribs, a three-lobed or cross-shaped or star-shaped section, etc., the bars or rods (11) arriving from a coiled package (12), the combined assembly being suitable to process one bar or rod at a time and comprising substantially on one and the same plane a feeder unit and a straightener unit and including in sequence a first feeder unit (14), a first straightener unit (20), a second feeder unit (21) and a second straightener unit (23), downstream of which is included an orthogonal adjustment unit (24) cooperating with a contrast unit (27), the second straightener unit (23) inducing in the bars or rods (11) a general path consisting of a half-loop (22).

17 Claims, 1 Drawing Sheet

COMBINED ASSEMBLY TO STRAIGHTEN AND LINEARIZE BARS OR RODS

This invention concerns a combined assembly to straighten and linearize bars or rods, as set forth in the main claim.

According to the invention the bars or rods may have a substantially round section or related thereto section.

The bars or rods may consist of bars or rods with a round section and ribs, a round section with protrusions, a round section with TOR-type helicoidal ribs or a three-lobed or cross-shaped or star-shaped section, and be straight or twisted and be of the type used in building work, for instance.

The assembly according to the invention can also be used on round tubes.

The assembly according to the invention is employed advantageously to straighten rods or bars unwound from coiled packages, but can also be used to straighten lengths of bars. It has been designed to straighten and linearize bars or rods at a speed of at least 1.2 to 1.5 metres per second and advantageously but not only of 3 to 4 metres per second.

This invention is applied properly to all cases where the rod or bar, owing to its geometric structure and/or to its production process and/or to its winding into coiled packages or to its unwinding, tends to rotate about its own axis during the straightening step.

The invention is employed in the straightening of rods or bars having a round or equivalent section and a diameter between 4 and 20 mm.

It is known that a rod or bar, whether it be solid or has a hollow tubular section or has been made with a hot or cold process, changes its initial section progressively by undergoing gradually increasing distortions during the rolling process owing to the wear of the rolling rolls. Its original condition is restored only by replacing the rolling rolls or rolling rings.

It is also known that a rotation depending on the direction of rotation of the winding machine is induced in the circumference of a rod or bar leaving the winding machine, whether the rod or bar is solid or tubular.

This circumferential rotation causes in the product a twist with a variable pitch. This twist is fixed in the product when the latter has been wound in coils, and such fixture is more evident when the product has been wound in the hot state and has cooled down in the coiled condition.

Depending on the system employed to unwind the product from the coiled package, this twist remains or tends to increase during the unwinding.

In a round rod intended, for instance, for building work lengthwise surface ribs are produced during the rolling step and have a generally uniform, linear development.

After being coiled, the rod or bar still has the surface ribs but their development has by then become substantially helicoidal.

It is also known that in a rod or bar non-homogenous forces may appear and be produced and fixed which impart an auxiliary twist to the axis of the product, this twist becoming apparent on the surface of such product.

This auxiliary twist may affect only segments of the product and is added algebraically to the winding twist and unwinding twist.

During straightening this plurality of twists (of the coiling and unwinding together with auxiliary twists) in conjunction with the non-homogeneous section of the rod or bar induces in the product a discontinuous reaction with a movement of rotation of the product about its own axis.

This discontinuous movement of the product about its own axis during the straightening step has neither a constant sign nor constant intensities along the whole product.

This lack of structural continuity has the effect that with the methods now employed the product is never straightened satisfactorily.

Next, it should be borne in mind that the straightening of a rod or bar at a low speed is very different from straightening a rod or bar which is travelling at a high or very high speed.

A low speed gives the material the necessary time to adapt itself to the induced deformations, but this does not take place when a rod or bar travelling at least at two metres per second is straightened.

At this high speed the traditional systems cannot respond effectively since the natural hysteresis of the material requires more time to allow the material to react and adapt itself stably to the new conditions.

Moreover, when a product straightened at a high speed according to the state of the art is employed to produce required geometrical shapes, shaped rod for building work for instance, these required geometrical shapes are hard to obtain in forms identical to or like the theoretical geometrical shapes owing to the tensions which remain in the product and which the straightening has neither removed nor fixed.

Furthermore, the final uniformity of these geometrical shapes is found to be variable and varies even with a considerable lack of uniformity.

Manifold systems have been disclosed to obviate the above shortcomings.

U.S. Pat. No. 299,615 provides for a plurality of rolls positioned in a spiral form and performing the straightening function; the assembly of these rolls rotates about the imaginary axis of the wire. This system may be satisfactory to process wire but is not suitable to prevent rotation of the product about its own axis nor to process a wide range of sections.

U.S. Pat. No. 731,675 discloses a straightening machine which, starting with bars, straightens T-bars and angle irons. This patent deals with a product not linked to our present invention and provides a plurality of rolls positioned at an angle and processing a bar kept substantially linear.

GB 124,574 discloses a straightening machine with sleeves rotating about the axis of the product to be straightened, and positioned as required within a rotary support conduit. This invention may work where rod is to be straightened at relatively low speeds but becomes useless when it is necessary to straighten rods or bars of the type indicated in the preamble.

U.S. Pat. No. 2,084,746 discloses a straightening machine which employs roller-type rotors to guide the rods or bars better. This system has the same limits as U.S. Pat. No. 299,615.

U.S. Pat. No. 2,720,243 discloses a machine to straighten rods or bars which is able to process only products the geometric shape of which enables the rolls to obtain a secure guide.

U.S. Pat. No. 3,068,931 discloses a straightening machine with rotary mandrels which is not suitable to process sections nor to process products already containing significant twists.

FR 1.469.905 discloses the straightening of sections with a system of rotary sleeves; to do so, it provides straightening means which in one segment of the straightening machine are positioned so as to induce a circular or ovalised development; this system may be suitable for tubular or solid bodies which have a square or rectangular section and are already substantially linear without induced twists.

FR 2.138.615 discloses a plurality of assemblies of rolls positioned at the vertices of a plurality of triangles rotated in relation to each other. This method does not permit the preventing of rotation of bars or rods of the type described in the preamble about their own axes.

EP-A-86102121.0 in the name of the present applicant discloses a plurality of straightening assemblies positioned at an angle to each other on more than one plane. This system ensures that the rod or bar does not rotate about its own axis, but it is extremely expensive, hard to make and adjust and takes up a great deal of space.

Moreover, although it prevents rotation, it does not provide the quality or constancy of straightening required even in bars having a length of twelve metres or more.

To prevent rotation of the rod or bar about its own axis during the straightening it is also possible to use a two-gripper drawing system, so that one gripper is always engaged so as to hinder rotation of the rod or bar. This system is very slow and does not ensure proper handling of the various types of rods or bars cited in the preamble.

EP-A-87202107.6 in the name of the preset applicant discloses a method and a straightening machine not permitting rotation in the straightening of rods or bars, whereby the rods or bars are diverted along loops having an S-shaped or Z-shaped development with an accentuated form during the actual straightening step.

The straightening step itself is preceded by a pre-straightening step and followed by a linearization and finishing step. The results of this processing configuration are acceptable but have still not satisfied the present applicant fully, above all when the speed of the rod or bar being straightened exceeds two metres per second.

FR-A-2252879 teaches the straightening of angle irons of great dimensions which are used for shipbuilding. This teaching merely provides for the coupling of counterrolls, having the task of retaining in position the irons, to the normal straightening rolls. This teaching comprises a classic straightening machine in which a mechanical pressure counterroll is associated with each straightening roll so as to straighten that specific angle iron profile.

GB-A-2,085,774 provides for a normal straightening machine with independent upper rolls and front and rear drawing assemblies; this machine has a great power and is employed to straighten mainly angle irons and I-beams, etc.; it also straightens round bars but only as an extension of the field covered. It is not able to fix the twists in a round bar being unwound from a coiled bundle, nor does it tackle this problem.

For this reason the present applicant has designed, tested and embodied an improved straightening system able to meet even the most demanding requirements, in which the rod or bar passes through at a speed of more than two metres per second.

The purpose of this invention is to achieve high-speed straightening of the rods or bars having a round or equivalent section, whether solid or hollow, and a diameter between 4 mm. and 20 mm., without the rods or bars having to rotate about their axis and without their inner or outer structures having to undergo modifications.

By "high-speed straightening" are meant straightening speeds higher than two metres per second.

It is also a purpose of this invention to be able to straighten with the same equipment rods or bars having as their section a plurality of different geometrical figures with different sections, but all the figures being substantially round or related to a round section.

Another purpose of this invention is to improve the drawing of the rods or bars during the straightening step.

Yet another purpose is to obtain the straightening of the rods or bars in all their angular positions, even though lengthwise, along the diametrical plane passing through their centre and through each of such angular positions, the section of the rods and bars has a differentiated geometrical and not constant configuration along that plane (for instance, a round configuration with projections for building work).

A further purpose of the invention is to exert on the straightened product a linearization action at high straightening speeds.

The invention has the purpose of achieving the straightening with equipment lying substantially wholly on the same plane.

The invention is set forth in the main claim, while the dependent claims describe various features of the invention.

The combined straightening and linearization assembly according to the invention comprises a first straightening unit providing a substantially linear path for the rods or bars. This first straightening unit is preceded by a first intake feeder unit and is followed by a second outlet feeder unit.

A half-loop with a desired, controlled development is imparted to the rod or bar leaving the second feeder unit.

The arrangement of the rolls of a second straightening unit defines the half-loop and prevents the rod or bar rotating about its own axis.

At least one of the rolls of each of the pair of rolls of the above units is powered to ensure that the rod or bar is always under traction during the straightening process.

According to a variant at least one of the lower rolls of the first straightening unit, which are not movable vertically, is capable of axial displacement so as to act as a means to stretch and fix the twists in the rods or bars and as a clamping element.

According to another variant at least one of the lower rolls of the second straightening unit, which are not movable vertically, is capable of axial displacement so as to act as a means to stretch and fix the twists in the rods or bars and as a clamping element.

Such lower roll will advantageously be the outlet roll of the straightening unit.

At the end of the loop segment the necessary forces are applied to linearize and finish the product by giving it a linear form free from defects. This is achieved by means of an orthogonal adjustment unit cooperating with a successive contrast unit.

The orthogonal adjustment unit comprises a roll capable of being moved both on the vertical plane containing the other rolls and axially, so that it can be positioned as required to perform any final necessary correction and the required clamping and fixture of the twists.

The combined assembly of the invention from the intake feeder unit to the final contrast unit is developed substantially on one and the same plane.

According to a variant a static switch means able to facilitate the path of the rod or bar being introduced is included at the outlet, and possibly at the intake, of the straightening units and is solidly fixed to the upper vertically movable rolls.

According to the invention the rolls may include one or more hollows suitable to process different sections or groups of sections.

These and other special features of the invention will be made clearer in the following description.

The attached figures, which are given as a non-restrictive example, show the following:

Figure 1:
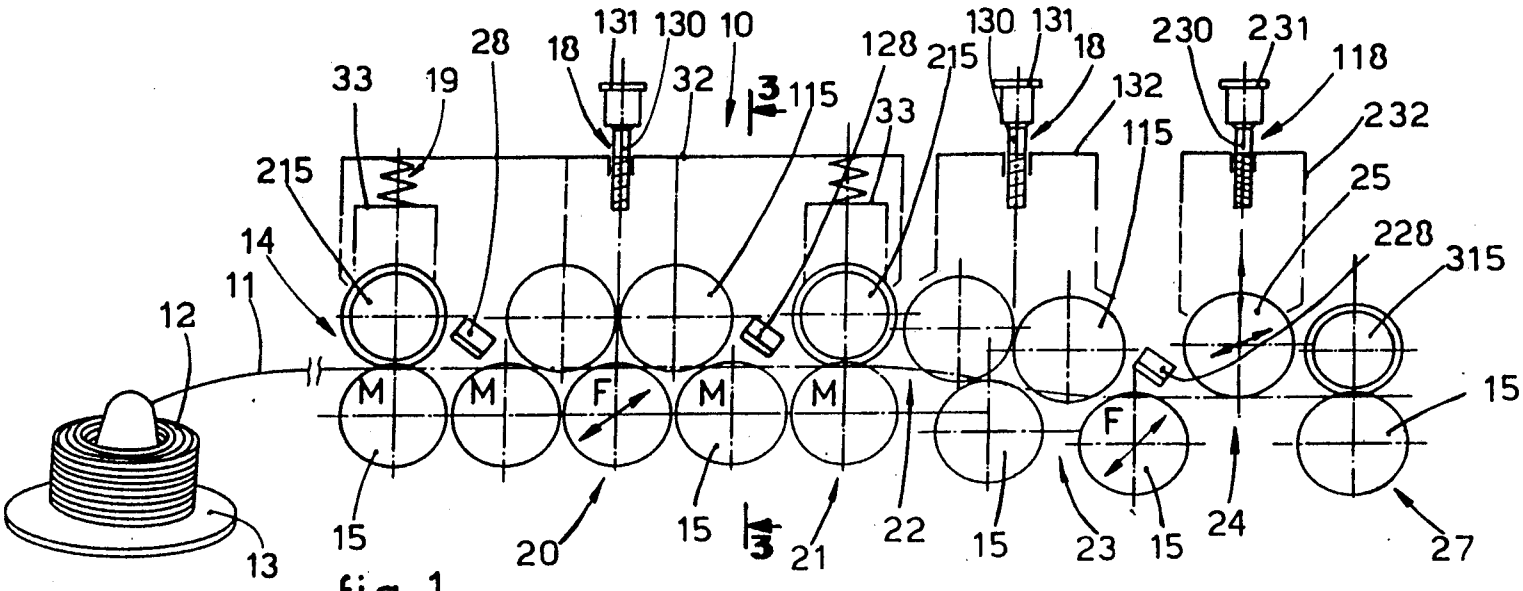
FIG. 1 is a diagrammatic side view of a combined assembly to straighten and linearize bars or rods according to the invention.
Figure 2:
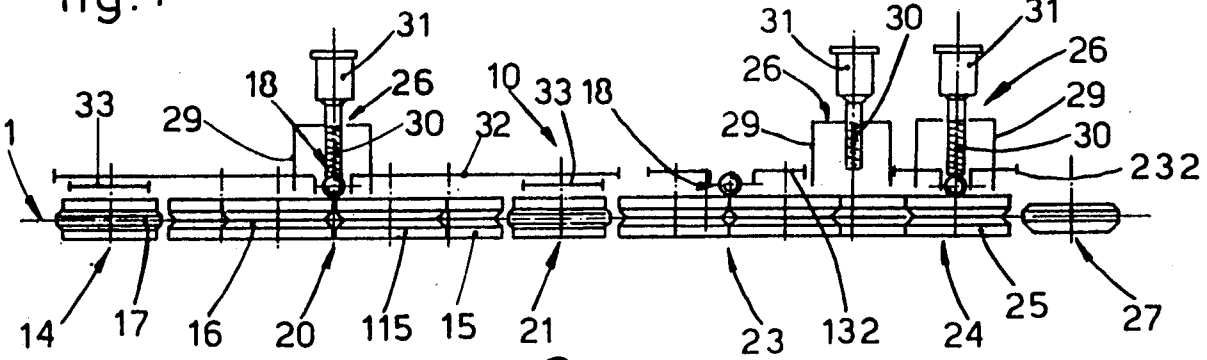
FIG. 2 is a plan view of the assembly of FIG. 1.

In the figures a combined straightening and linearization assembly 10 according to the invention is applied to a rod or bar 11 being unwound in this case from a coiled package 12 positioned on a feeder reel 13 of a known type.

During the coiling of the package 12, and depending on the type of coiling, a twist has been imparted to the rod or bar 11 and has made the development of the lengthwise fibres spiral and has also made spiral the development of any ribs which were linear along the axis of the rod or bar during the rolling step and during preparation in general.

As is known, when the rod or bar 11 is unwound from the package 12, this spiral development thereof remains or is accentuated, depending on the type of unwinding.

According to the invention the rod or bar 11 is first made to pass into a first intake feeder unit 14 consisting of a pair of rolls 15-215, the lower roll 15 being powered (M) whereas the upper roll 215 is an idler.

The rolls 15-215 of the intake feeder unit 14 are positioned facing each other and comprise a channel 16 containing the rod or bar 11 (roll 15) and a male projection cooperating with the channel 16 (roll 215) respectively.

Thus one roll 15 comprises the containment channel 16 having an angle of about 90° at its vertex, whereas the other roll 215 coupled with the first roll 15 comprises a peripheral projection 17 having an angle of about 90° at its vertex and cooperating with the channel 16.

The second roll 215, which is an idler, is connected to a system 18 providing vertical adjustment of its working position in relation to the rod or bar 11. Such adjustment may be applicable to the second roll 215 alone, and in this case the roll 215 will be upheld on an independent support 33; or else the adjustment may be applicable to other rolls too, as we shall see later.

The idler roll 215 of the intake feeder unit 14 includes advantageously thrust means 19 too, which exert an action of a constant or variable value, as required, on the rod or bar 11. These thrust means 19 will be, for instance, a spring if an action of a constant value is required, or else a jack if an action of a variable value is required.

A first straightening unit 20 consists of lower rolls 15 and upper rolls 115; in this case there are three lower rolls 15 and two upper rolls 115, the latter 115 being located opposite the spaces between the lower rolls 15.

The upper rolls 115 can be moved in their plane of containment, whereas two of the lower rolls 15 are stationary and at least one 15F, the central roll, can only move axially.

The first straightening unit 20 processes the rod or bar 11 arranged along a substantially straight path.

According to the invention the axially movable central lower roll 15F is advantageously an idler roll, whereas the other two lower rolls, referenced with 15M, are powered.

As the central lower roll 15F can be moved axially by a device 26, that roll 15F can also act on the rod or bar 11 in a direction normal or at an angle to the plane on which the rolls lie, thus providing an action of further stretching and fixing of the twists existing at that point in the rod or bar 11 passing through.

The roll movement device 26 provides a support 29 for the lower roll 15F, which, as we said above, is advantageously supported so as to idle and to be moved in an axial direction on guides, for instance.

The positioning of the support 29 and therefore of the movable lower roll 15F is obtained, for instance, by a threaded actuation shaft 30 driven by a motor 31.

As we said earlier, the upper rolls 115 can move in the plane on which the rolls lie, and are idler rolls. They can be displaced simultaneously by a first adjustment system 18 that acts on one single support 32, which upholds the reciprocally positioned upper rolls 115 and possibly 215.

The support 32 can move on guides and the first adjustment system 18 comprises, for instance, a threaded actuation shaft 130 driven by a motor 131.

The upper and lower rolls 15-115 of the first straightening unit 20 are staggered in relation to each other by a value required to ensure an optimum retention of the rod or bar 11 along its path.

Figure 3:
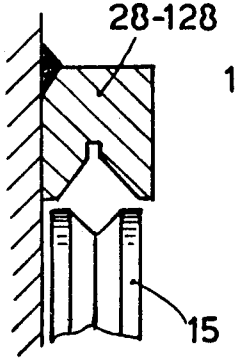
FIG. 3 shows a partial section along the line A—A of FIG. 1.

According to the invention a first switch 28 and a second switch 128 are included in cooperation with the entry and/or exit respectively of the first straightening unit 20 and are shown in a diagrammatic section in FIG. 3. In this case the switches 28 and/or 128 are solidly fixed to the plate which has the purpose of displacing the idler rolls 115, and are positioned at an angle to the direction of arrival of the rod or bar 11 so as to divert the rod or bar 11 towards the successive roll.

The rod or bar 11 meets thereafter an outlet feeder unit 21 having features analogous to those of the intake feeder unit 14.

Besides their drawing action the two feeder units 14-21 exert on the rod or bar 11 an action of compression, thus enabling the rod or bar 11 to be measured thereafter by a contrast and measurement unit 27 without any difficulty.

The rod or bar 11 leaving the outlet feeder unit 21 is made to pass along a half-loop 22, which in this case is directed downwards but could equally well be directed upwards.

In the embodiment shown the outlet feeder unit 21 is positioned at the highest part of the half-loop 22, while a second straightener unit 23 works along the path of the half-loop 22. In this example the second straightener unit 23 consists of two pairs of reciprocally staggered upper and lower rolls 15-115; the first pair of upper and lower rolls 15-115 is arranged on a part of the half-loop 22, whereas the second pair of upper and lower rolls 15-115 is positioned at the lower part of the half-loop 22.

One of these lower rolls 15F is analogous to the lower idler roll 15F of the first straightening unit 20 and can move axially in the same manner; this lower idler roll 15F of the second straightening unit 23 is advantageously the last roll of that unit 23 in the direction of movement of the rod or bar 11.

In the same manner the second straightening unit 23 is connected to a second vertical adjustment system 18 analogous to the first adjustment system 18 and comprising a support 132, threaded actuation shaft 130 and motor 131.

A switch 228 may be included at the outlet of the second straightening unit 23.

At the departure end of the half loop 22 the rod or bar 11 encounters an orthogonal adjustment unit 24, which consists of an adjustment roll 25 in this case. The adjustment roll 25 can be displaced by a vertical adjustment unit 118, which contains a support 232, threaded actuation shaft 230 and actuation motor 231 and supports a horizontal adjustment unit 26.

The adjustment roll 25 can move in four directions along two cartesian axes contained in a plane substantially normal to the axis of the rod or bar 11.

The orthogonal adjustment unit 24 lies substantially on the same plane as the feeder units 14-21 and straightening units 20-23 detailed above and enables the rod or bar 11 to be correctly linearized by cooperating with a lower roll 15 of a downstream contrast unit 27.

If the contrast unit 27 consists of a pair of facing upper and lower rolls 315-15, it can also act as a measurement unit.

Depending on the position taken up by the orthogonal adjustment unit 24, the rod or bar 11 leaving the contrast unit 27 can take up any three-dimensional position within a conoid the vertex of which lies between the upper and lower rolls 315-15 of the contrast unit 27.

The upper and lower rolls 15-115-215-315 may comprise a groove or track so as to be suitable to process a rod or bar 11, or may comprise two or more grooves or tracks so as to be suitable to process different sizes or groups of sizes of rods or bars 11 by displacing the rod or bar to be processed into the necessary groove or track.

We claim:

1. A combined assembly to straighten and linearize a bar or rod from a coiled package being fed through said combined assembly comprising:

a first straightening unit comprising a plurality of upper and lower rolls opposed to and staggered with one another;

inlet feeder means for feeding said section to said first straightening unit and being provided immediately upstream of said first straightening unit;

outlet feeder means for withdrawing said bar or rod from said first straightening unit and being provided immediately downstream of said first straightening unit;

a second straightening unit comprising a plurality of upper and lower rolls opposed to and staggered with one another, said second straightening unit being provided downstream of said outlet feeder means wherein at least one of said plurality of rolls of said second straightening unit can move along it own axis of revolution;

a contrast unit comprising opposing upper and lower rolls and being provided downstream of said second straightening unit; and orthogonal adjustment means for contacting said bar or rod and directions normal to an axis of said bar or rod, said orthogonal adjustment means being provided between said second straightening unit and said contrast unit;

wherein said inlet feeder means, said first straightening unit, said outlet feeder means, said second straightening unit, said orthogonal regulation means, and said contrast unit are positioned so as to lie on substantially a single plane; and wherein a generally half-loop bend is imparted to said bar or rod between said outlet feeder unit and an exit of said second straightening unit and wherein said second straightening unit is positioned on a path of said bar or rod including said bend.

2. A combined assembly according to claim 1, wherein said at least one roll of said second straightening unit which can move along its own axis of revolution is a lower roll immediately upstream of said exit of said second straightening unit.

3. A combined assembly according to claim 1, wherein each of the inlet feeder means and outlet feeder means consists of a pair of opposing rolls, at least one of said pair of opposing rolls being stationary and powered.

4. A combined assembly according to claim 3, further comprising resilient pressure means for resiliently pressing the other of said pair of rolls of said inlet feeder means and said outlet feeder means towards said bar or rod.

5. A combined assembly according to claim 3, wherein one of said pair of rolls of said inlet feeder means includes a circumferential channel to contact said bar or rod and the other of said pair of rolls of said inlet feeder means includes a peripheral projection which cooperates with said channel to laterally fix said bar or rod.

6. A combined assembly according to claim 3, wherein one of said pair of rolls of said outlet feeder means includes a circumferential channel to contact said bar or rod and the other of said pair of rolls of said outlet feeder means includes a peripheral projection which cooperates with said channel to laterally fix said bar or rod.

7. A combined assembly according to claim 1, wherein at least one of said plurality of rolls of said first straightening unit can move along its own axis of revolution.

8. A combined assembly according to claim 1, wherein said orthogonal adjustment means comprises an adjustment roll and means for moving said adjustment roll along its axis of revolution and in an orthogonal direction normal to an axis of the bar or rod.

9. A combined assembly according to claim 1, wherein said contrast unit includes means for measuring said bar or rod.

10. A combined assembly according to claim 1, further comprising means for laterally fixing said bar or rod between said upper and lower rolls of said first straightening unit and said second straightening unit.

11. A combined assembly according to claim 10, wherein said means for laterally fixing said bar or rod between said upper and lower rolls of said first straightening unit and of said second straightening unit comprises a circumferential channel to contact said bar or rod in each of said upper and lower rolls.

12. A combined assembly according to claim 17, in which a switch to divert the leading end of the bar or rod is included at of the outlet of the inlet feeder means.

13. A combined assembly according to claim 1, in which a switch to divert the leading end of the bar or rod is included at the outlet of the first straightener unit.

14. A combined assembly according to claim 1, in which a switch to divert the leading end of the bar or rod is included at the outlet of the second straightener unit.

15. A combined assembly according to claim 3, in which the upper rolls of the inlet and outlet feeder means and of the first and second straightener units can be regulated on the plane on which they lie.

16. A combined assembly according to claim 1, in which the outlet feeder means is positioned at the highest point of the general half-loop bend.

17. A combined assembly according to claim 16, in which one pair of rolls of the second straightener unit is arranged substantially at the lowest part of the general half-loop bend.

* * * * *